US006260504B1

(12) United States Patent
Moles et al.

(10) Patent No.: US 6,260,504 B1
(45) Date of Patent: Jul. 17, 2001

(54) MULTI-ROV DELIVERY SYSTEM AND METHOD

(75) Inventors: Peter Andrew Robert Moles, Houston; Donald Wayne Hammond, Katy, both of TX (US); Kevin F. Kerins, Inverurie (GB); Govind Shil Srivastava, Austin, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 09/489,062

(22) Filed: Jan. 21, 2000

(51) Int. Cl.[7] ..... B63G 8/00
(52) U.S. Cl. ..... 114/312; 405/191
(58) Field of Search ..... 114/312, 330, 114/337, 338; 405/190, 191

(56) References Cited

U.S. PATENT DOCUMENTS 4,010,619 * 3/1977 Hightower et al. ..... 114/312
4,686,927 8/1987 Hawkes et al. ..... 114/312
4,721,055 1/1988 Pado ..... 114/331
4,740,110 * 4/1988 Saffrhan ..... 405/225
5,069,580 12/1991 Herwig et al. ..... 405/191

* cited by examiner

*Primary Examiner*—Sherman Basinger
(74) *Attorney, Agent, or Firm*—Duane Morris & Heckscher LLP

(57) ABSTRACT

A TMS, cage type or top hat type incorporates a deployment frame. The TMS may be operated by a winch from a surface vessel. The TMS delivers a main ROV and a smaller mini ROV. The main ROV is fully functional to accomplish the necessary task subsea. However, in the event there is an operational failure of the main ROV, the mini ROV can be deployed. The mini ROV may have fewer functionalities than the main ROV, but can at least offer video and lighting to allow monitoring of a particular location subsea. All the necessary positioning capabilities are available on the mini ROV.

15 Claims, 5 Drawing Sheets

MULTI-ROV DELIVERY SYSTEM AND METHOD

FIELD OF THE INVENTION

The field of this invention relates to equipment and methods for deploying remotely-operated vehicles (ROV) subsea.

BACKGROUND OF THE INVENTION

Typically, when exploration or servicing must occur in deep water, ROVs are used for access to a site and for completion of a variety of different tasks. ROVs are generally self-propelled for proper positioning, and include manipulation linkages to allow such activities as turning valves to be accomplished by the ROV. The ROV typically also has video equipment and lighting to allow personnel at the surface to better direct its movements for proper positioning to accomplish a specific job. ROVs are frequently deployed using structures known as tether management systems (TMS). A deployed tether management system can be either a cage type with the ROV stored inside it or a top hat type with the ROV stored below it. The TMS with ROV is lowered from a vessel at the surface with a winch system. When the TMS reaches close to the seabed, the ROV is actuated to disengage from the TMS, and is thereafter directed to the work site location. The ROV is tethered to the TMS to facilitate its operation by the transmission of power and signals to the ROV from the surface through the TMS.

One of the problems in deploying ROVs is the space required on the surface vessel to house the TMS and ROV. Typically, a surface vessel will include a single ROV with a TMS to accomplish a particular task. If mechanical or other difficulties ensue with regard to the ROV, there can be significant delays before a replacement unit can be brought to the surface vessel. A replacement unit would also require additional deck space.

As previously stated, ROVs accomplish a variety of different functions. In many applications, the purpose of the ROV is really to illuminate and transmit video to the surface for monitoring of particular subsea equipment or condition. It is therefore one of the objects of the present invention to allow the ability to perform certain tasks which require an ROV, even if the main ROV on the surface vessel experiences operational difficulties. This objective of the present invention is resolved by configuring a TMS to not only accept a main ROV, but also a smaller mini ROV, preferably housed directly below the cage type TMS or housed within the top hat type TMS. Accordingly, if problems ensue with the main ROV, certain functions can continue to be accomplished with the mini ROV until a replacement ROV is delivered to the surface vessel. The configuration into a compact package is another objective of the present invention. Depending on the space availability of the particular application, the mini ROV can have some or most, if not all, the capabilities of the original ROV. Practically, in most applications, the mini ROV will have substantially fewer capabilities than the principal or main ROV.

Illustrative of use of ROVs in the prior art are U.S. Pat. Nos. 4,010,619, 4,686,927, 4,721,055 and 5,069,580. These and other benefits of the present invention will be readily apparent to those skilled in the art from a review of the description of the preferred embodiment below.

SUMMARY OF THE INVENTION

A TMS, cage type or top hat type incorporates a deployment frame and is operated by a winch from a surface vessel which delivers a main ROV and a smaller mini ROV. The main ROV is fully functional to accomplish the necessary task subsea. However, in the event there is an operational failure of the main ROV, the mini ROV can be deployed. The mini ROV may have fewer functionalities than the main ROV, but can at least offer video and lighting to allow monitoring of a particular location subsea. All the necessary positioning capabilities are available on the mini ROV.

DETAILED DESCRIPTION OF THE DRAWINGS

DETAILED DESCRIPTION OF THE PREFERRED EMBODIMENT

This invention is designed to operate with a "deployment frame" which is a support structure. It can internally support a main ROV 16 and a mini ROV 26 in which case it is also known as a cage. It can also be a part of a tether management system (TMS) which in a top hat format supports the main ROV 16 from within or underneath while the mini ROV 26 is supported from within.

Figure 1:
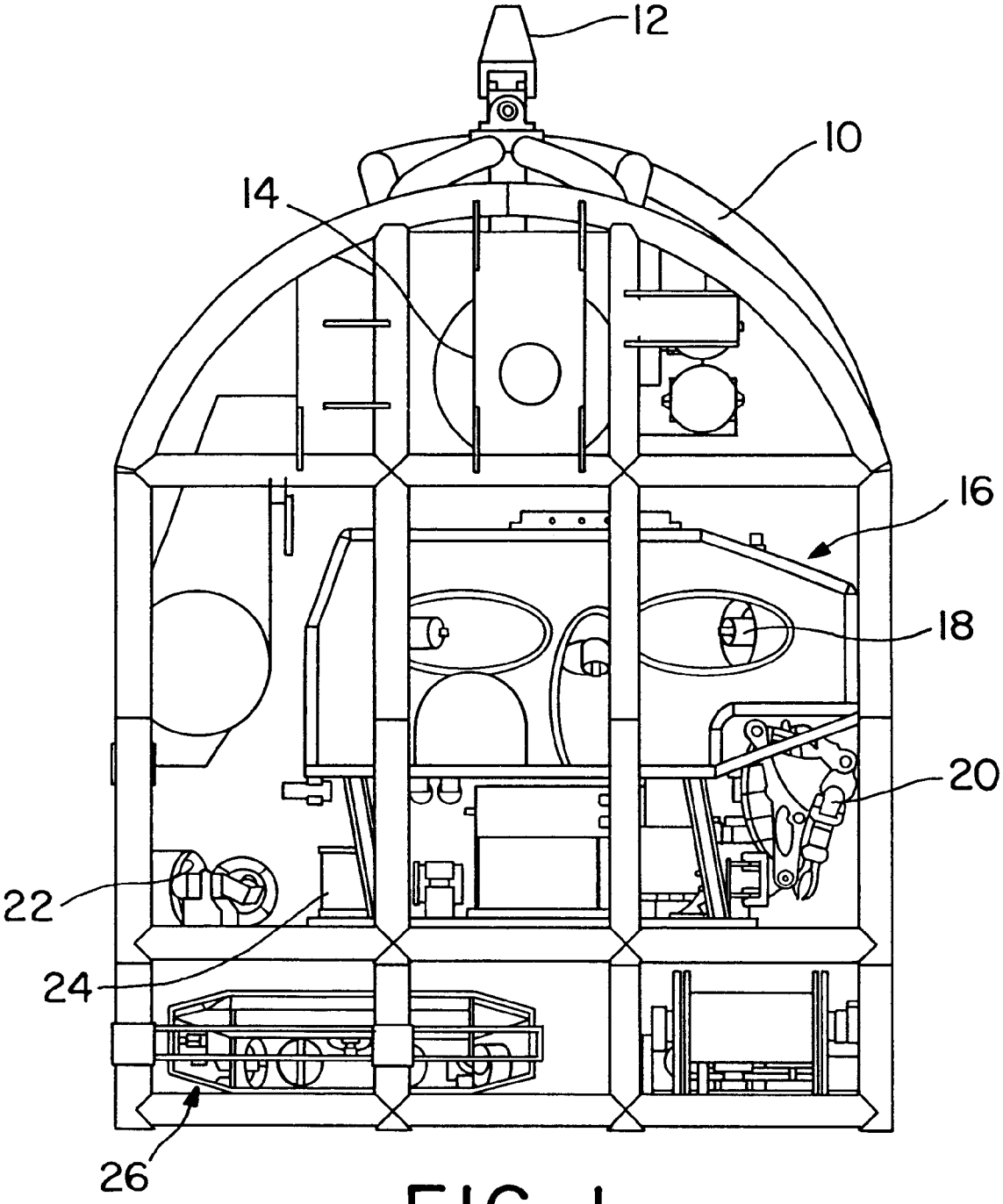
FIG. 1 is an elevational view of the TMS, in this instance the cage type, showing the main and mini ROVs in a stacked relationship inside a deployment frame.
Figure 2:
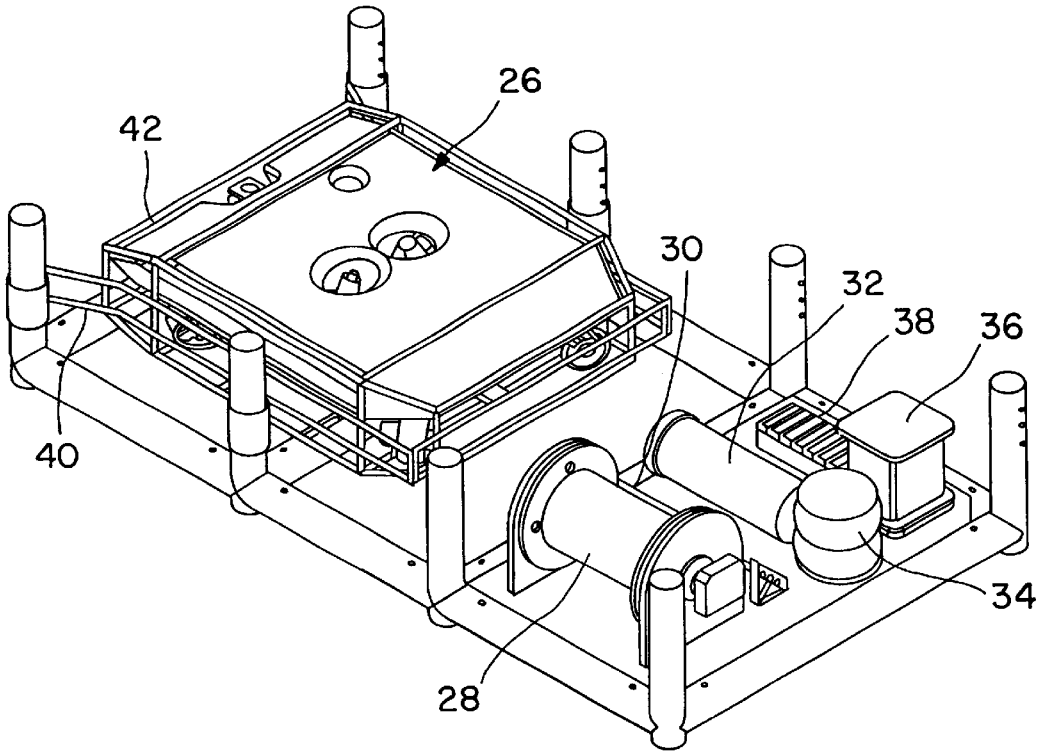
FIG. 2 is a perspective view of the lower portion of the deployment frame shown in FIG. 1 adjacent the ROV.
Figure 3:
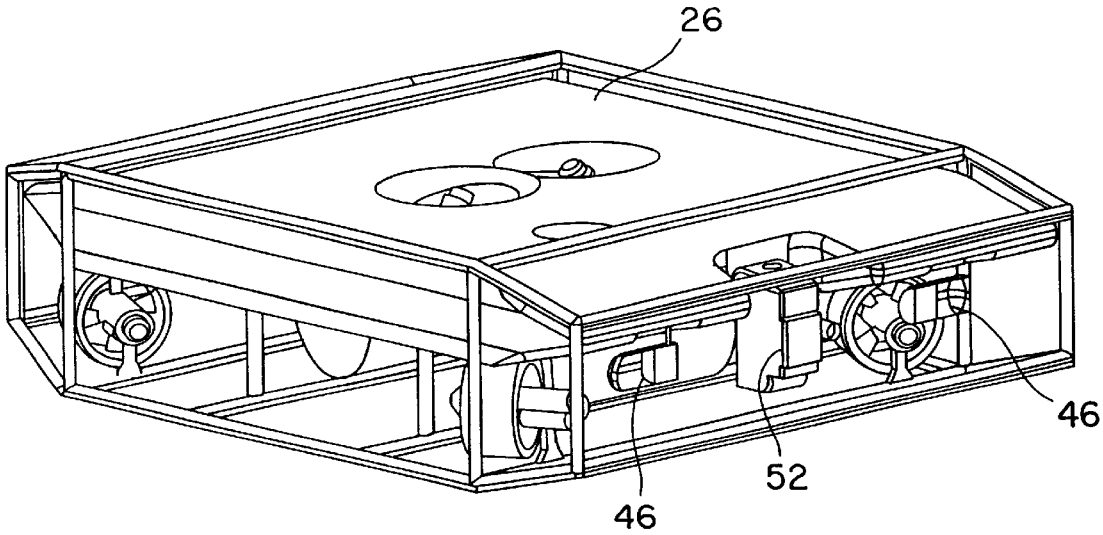
FIG. 3 is perspective view of the mini ROV.
Figure 4:
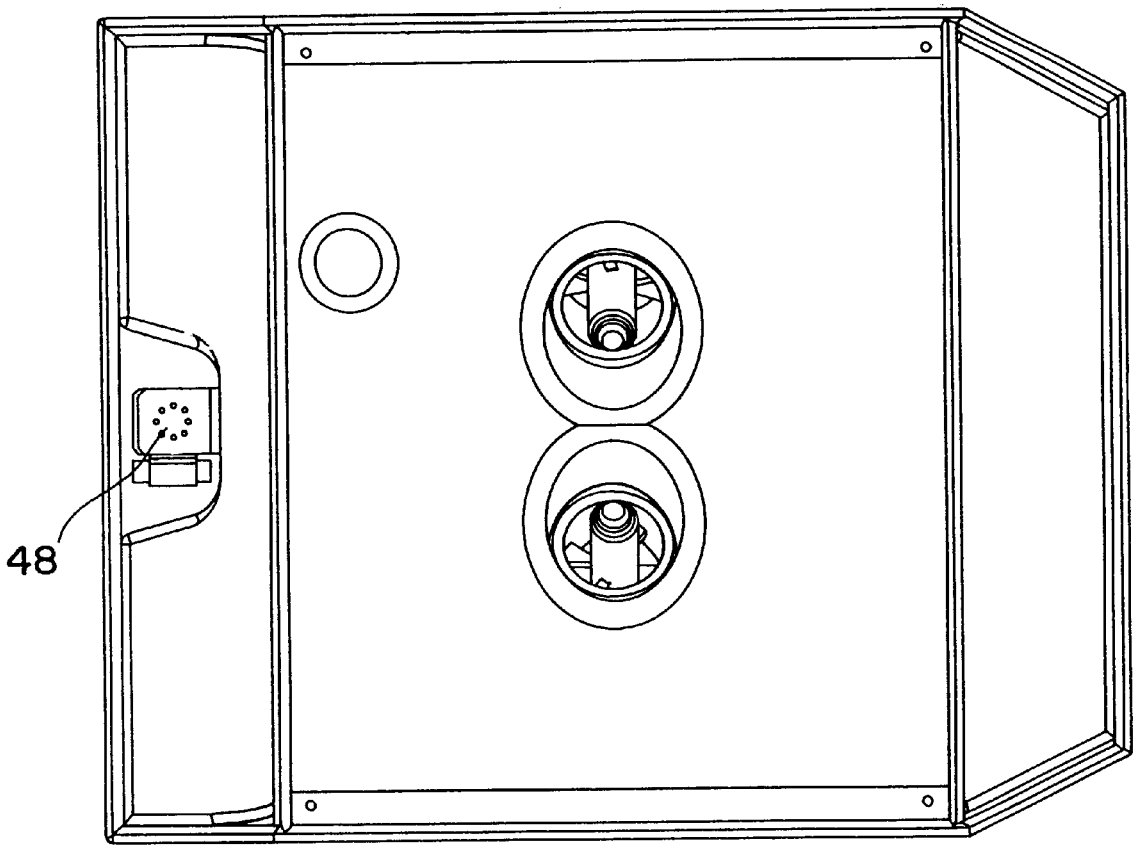
FIG. 4 is a top view of the mini ROV.
Figure 5:
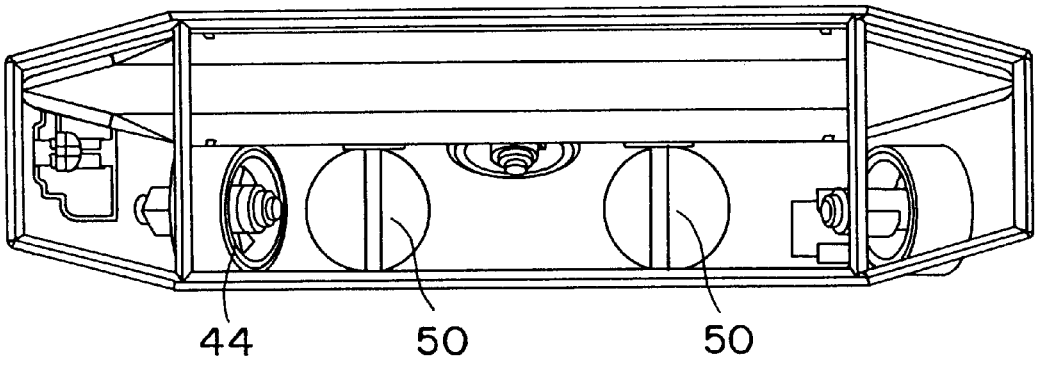
FIG. 5 is an end view of the mini ROV.

Referring to FIG. 1, the cage type TMS comprises a deployment frame 10 is initially supported on a surface vessel (not shown) and is connected to a boom on such vessel so that it can be swung overboard. A cable attached to a bullet 12 at the top of deployment frame 10 allows for raising and lowering of the deployment frame 10. The main ROV 16 is a design well known in the art. It typically has a plurality of thrusters 18 as well as manipulators 20. The position of the TMS can also be controlled with thrusters 22 if the TMS is powered; some TMS types have no thrusters attached. The deployment frame 10 has an open end adjacent the manipulators 20 to allow the main ROV 16 to emerge from the deployment frame 10. Deployment frame 10 also includes a transformer 24, integrated into the ROV 16. Mounted below in deployment frame 10 is the mini ROV 26 which is better shown in FIG. 2. A winch 28 is mounted in the deployment frame 10 that allows the mini ROV 26 to be retrieved by its tether. The winch 28 is a tether management system that pays out or takes up the tether to facilitate ROV movements. The cable extends over a pulley 30 which is partially hidden in FIG. 2 and disposed between the winch 28 and the electronics bottle 32. Also located on the deployment frame 10 adjacent the mini ROV 26 is a bladder 34 and a transformer 36. Adjacent the transformer 36 is a valve pack 38. A subframe 40 stabilizes the mini ROV 26 in deployment frame 10. The mini ROV 26 itself has a frame 42 and a plurality of thrusters 44 so that it can be properly positioned. The thrusters are illustrated in FIG. 5. The front of the mini ROV 26 is shown in FIG. 3. It has lights 46 and a camera 48 shown in FIG. 4. FIG. 5 illustrates the electronic bottles 50 which house, among other things, telemetry equipment. Adjacent the lights 46 is a pan/tilt control device 52.

Those skilled in the art will appreciate that the configuration of the mini ROV 26 can be changed without departing from the spirit of the invention. Although shown below the main ROV 16 to accommodate a retrofit to an existing cage, the mini ROV 26 can be placed above the much heavier main ROV 16 to add greater stability to the cage. For example, depending on the configuration of the main ROV 16 and the size of the deployment frame 10, additional or other features can be incorporated in the mini ROV 26 without departing from the spirit of the invention. A plurality of mini ROVs can also be deployed. Accordingly, the mini ROV 26 could potentially have manipulators for inserting or removing stabs or operating valves. In the particular instance of the preferred embodiment described in FIGS. 1–5, the capabilities of the mini ROV are more limited to allowing observation using the lights 46 and the camera 48. However, certain operations subsea only require monitoring. Accordingly such monitoring activities can continue while a replacement ROV is delivered to the surface vessel, or during the time that repairs are made to the ROV on the surface vessel or at a remote location. Additionally, the mini ROV 26 can be used in rescue operations of the main ROV 16, or they can complete certain tasks together. For example, while landing a "Christmas tree" or a blow-out preventer, the main ROV 16 and the mini-ROV 20 can operate together. If the tether on the main ROV 16 is tangled, the mini ROV 26 can grapple it and untangle it. The mini ROV 26 can also apply a hook to the main ROV 16 to aid in rescue efforts from the vessel at the surface. The mini ROV 26 can also take corrosion readings on pipes or vessels.

Those skilled in the art will readily appreciate that significant down-time can be eliminated without the sacrifice of valuable deck space on the surface vessel. A deployment frame 10 having the same footprint can now accommodate a reserve backup unit or multiple units which can allow certain operations to continue while the main ROV 16 is replaced or repaired.

Figure 6:
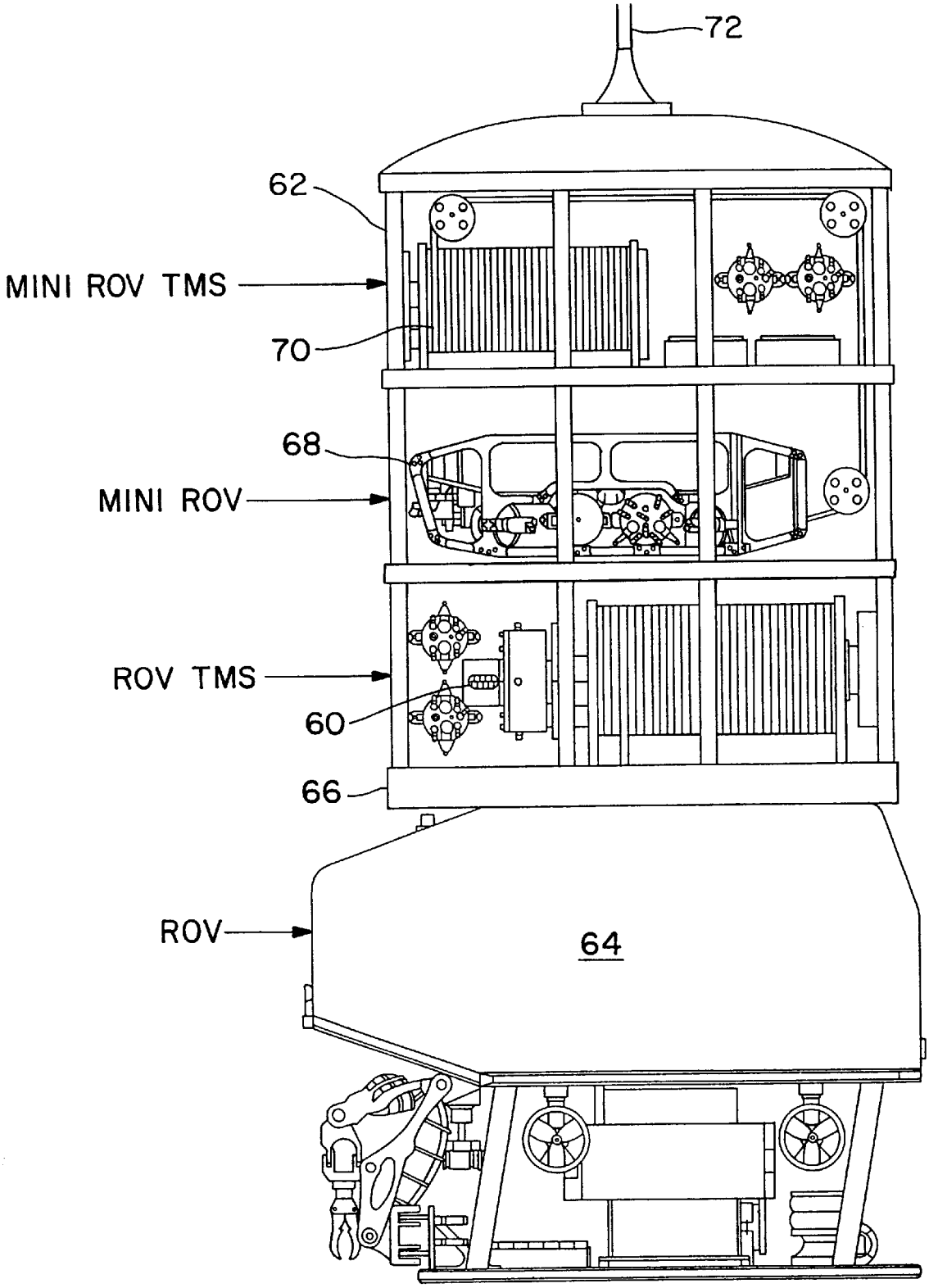
FIG. 6 is an elevational view of the top hat type TMS showing the relationship of the main and mini ROV's with respect to a deployment frame.

An alternative embodiment is shown in FIG. 6. This is the top hat arrangement which includes a tether management system 60 supported in a deployment frame 62. The main ROV 64 is suspended from the lower end 66 of the deployment frame 62. The mini ROV 68 is disposed within the deployment frame 62 and has its own tether management system 70. The deployment frame 62 is supported from the surface vessel by a support cable 72. Optionally, thrusters can be employed with the deployment frame 62 for positioning subsea. Those skilled in the art will appreciate the distinction using a deployment frame 10 and a deployment frame 62. In the first instance, both the main ROV 16 and the mini ROV 26 are mounted within the deployment frame 10. Whereas in the top hat design, employing a deployment frame 62 as shown in FIG. 6, the main ROV 64 is suspended below the deployment frame 62 while the mini ROV 68 is housed within the deployment frame 62.

Figure 7:
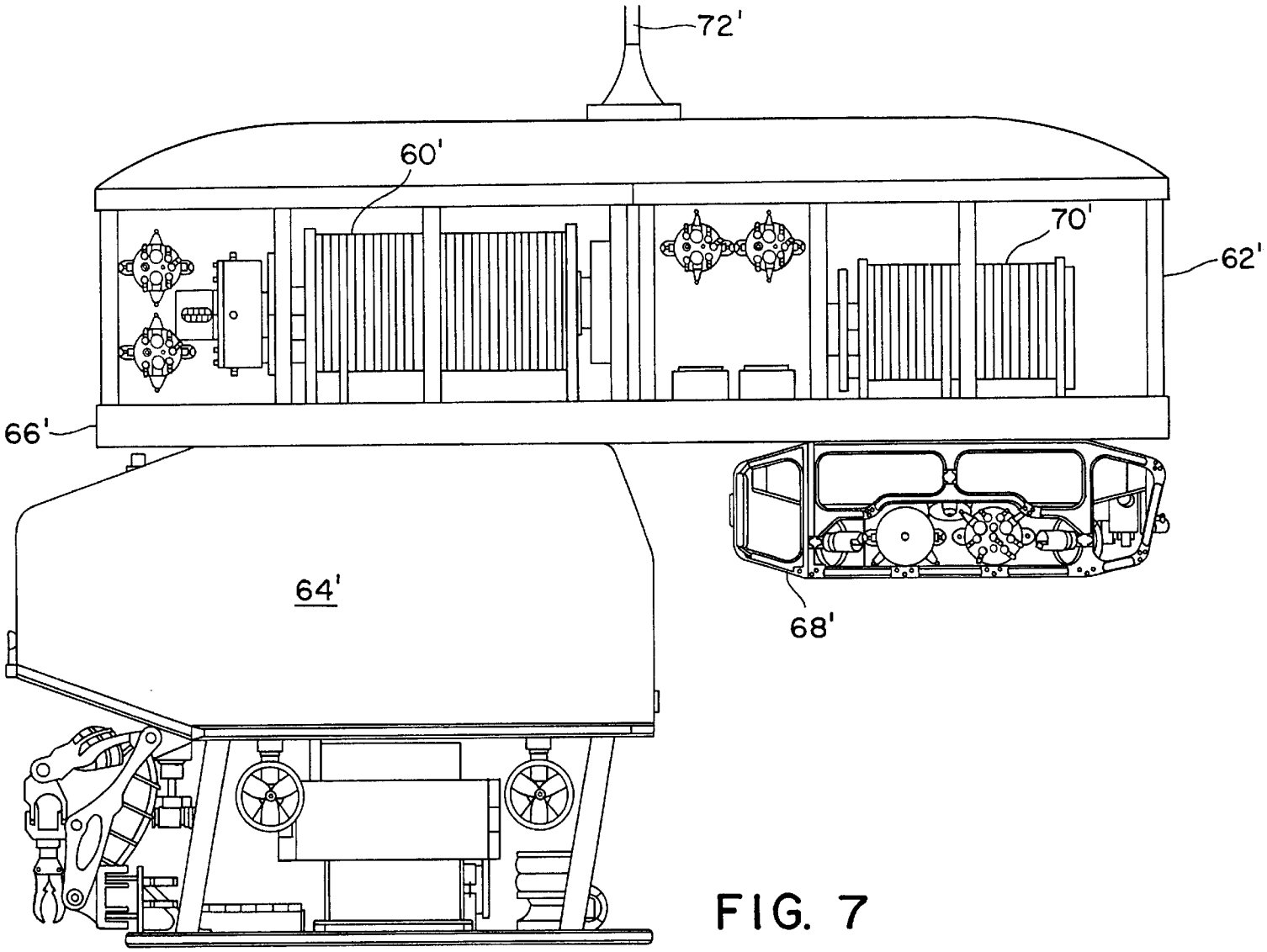
FIG. 7 is an elevational view of an additional embodiment of the invention.

FIG. 7 shows a further alternative embodiment in which the tether management system 60' is supported in a deployment frame 62'. The main ROV 64' is suspended from the lower end 66' of the deployment frame 62'. The mini ROV 68' is also disposed underneath the deployment frame 62' and has its own tether management system 70'. The deployment frame 62' is supported from the surface vessel by a support cable 72'. Optionally, thrusters can be employed with the deployment frame 62' for positioning subsea. The main ROV 64' and the mini ROV 68' are housed side by side, under the deployment frame 62'.

The above description is descriptive but not limiting of the claimed invention. It is merely illustrative thereof. The scope of the invention is to be determined from the attached claims, which appear below, and any and all variants within the range of equivalents of the claims.

We claim:

1. A system for deployment of ROV comprising:

a single integral deployment frame;

a main ROV separate from and supported by said single integral deployment frame; and at least one backup ROV separate from and supported by said single integral deployment frame, wherein the main and backup ROVs are supported by the single integral deployment frame independently of each other.

2. The system of claim 1, wherein:

said ROVs are positioned side by side.

3. The system of claim 1, wherein:

said ROVs are stacked vertically one above the other, each ROV positioned within or depending from the single integral deployment frame.

4. The system of claim 3, wherein:

said main ROV is supported from an underside of said deployment frame.

5. The system of claim 3, wherein:

said main and backup ROV's are supported within said deployment frame.

6. The system of claim 1, wherein:

said backup ROV comprises lighting and a camera.

7. The system of claim 1, wherein:

said backup ROV is operable independently of said main ROV.

8. The system of claim 1, wherein:

said backup ROV has some of the capabilities of said main ROV.

9. The system of claim 1, wherein:

said backup ROV has all the capabilities of said main ROV.

10. The system of claim 1, further comprising:

at least two winches for returning each of said ROVs to said single integral deployment frame, each of the two winches being positioned within the single integral deployment frame.

11. The system of claim 10 further comprising:

at least one thruster on said deployment frame independent of said ROVs.

12. The system of claim 10, wherein:

said deployment frame is unpowered.

13. The system of claim 10, wherein said winches are positioned one above the other, within the single integral deployment frame.

14. The system of claim 1, wherein:

said backup ROV further comprises lighting and a video camera.

15. The system of claim 1, wherein said single integral deployment frame is separate and distinct from a ship from which the deployment frame is deployed.

* * * * *